United States Patent [19]

Hamaguchi et al.

[11] Patent Number: 5,061,140

[45] Date of Patent: Oct. 29, 1991

[54] METHOD OF MANUFACTURING A METAL CONTAINER

[75] Inventors: Masami Hamaguchi, Takatsuki; Hiromu Yanagihara, Osaka; Osamu Hiraoka, Takatsuki; Osamu Takahashi, Nagaokakyo, all of Japan

[73] Assignees: Shiseido Company Limited, Tokyo; Asia Can Company Limited, Osaka, both of Japan

[21] Appl. No.: 359,493

[22] Filed: Mar. 31, 1989

Related U.S. Application Data

[63] Continuation of Ser. No. 93,718, Sep. 8, 1987, Pat. No. 4,892,214.

[30] Foreign Application Priority Data

| | | | |
|---|---|---|---|
| Sep. 8, 1986 | [JP] | Japan | 61-212502 |
| Mar. 4, 1987 | [JP] | Japan | 62-31242[U] |
| Mar. 23, 1987 | [JP] | Japan | 62-68466 |
| Mar. 23, 1987 | [JP] | Japan | 62-68467 |
| May 11, 1987 | [JP] | Japan | 62-114286 |
| Sep. 1, 1987 | [JP] | Japan | 62-219759 |

[51] Int. Cl.[5] ..... B21D 22/20; B21D 39/00

[52] U.S. Cl. ..... 413/6; 156/69; 413/20; 72/349

[58] Field of Search ..... 72/347–349; 413/4–7, 19, 20, 22, 34, 53; 156/69 X; 101/36.1

[56] References Cited

U.S. PATENT DOCUMENTS

| | | | |
|---|---|---|---|
| 2,162,776 | 6/1939 | Friden | 72/348 |
| 2,804,988 | 9/1957 | Dobbins, III . | |
| 3,199,712 | 10/1965 | Nurkiewicz . | |
| 3,731,838 | 5/1973 | Gedde . | |
| 3,912,154 | 10/1975 | Godar | 156/69 |
| 3,965,834 | 6/1976 | Dolveck | 220/67 |
| 4,155,794 | 5/1979 | Raabe et al. . | |
| 4,241,844 | 12/1980 | Dolveck . | |
| 4,452,368 | 6/1984 | Roth . | |
| 4,519,310 | 5/1985 | Shimizu et al. | 101/38.1 |
| 4,541,265 | 9/1985 | Dye et al. | 72/347 |
| 4,892,214 | 1/1990 | Hamaguchi et al. . | |

*Primary Examiner*—James G. Smith
*Assistant Examiner*—Jack Lavinder
*Attorney, Agent, or Firm*—Staas & Halsey

[57] ABSTRACT

A method of manufacturing a metal container by attaching a body formed integral with a top cover to a bottom plate formed separately. The body and bottom plate are sealably attached together with an adhesive and by a tight curl. The tight curl is formed toward the interior of the container and not exposed outside, thus making it pleasing to the eye.

11 Claims, 12 Drawing Sheets

METHOD OF MANUFACTURING A METAL CONTAINER

This is a continuation of co-pending application Ser. No. 07/093,718 filed on Sept. 8, 1987 now U.S. Pat. No. 4,892,214.

BACKGROUND OF THE INVENTION AND RELATED ART

The present invention relates to a method of manufacturing a metal container.

Heretofore, a container known as a three-piece can comprising a bottom, a cover and a body has been widely used for preservation of foodstuff. The three-piece can is constructed by bending a flat sheet into a cylindrical shape with the seam adhered or welded together to make the body and then curling the bottom and the cover tight to fasten them to the body.

A metal container was proposed which is manufactured firstly by drawing and ironing a thin sheet material into a cup-shaped can having a body integral with a bottom and then curling a cover tight to fasten it to the can. Compared with the three-piece can, this can is called a two-piece can from the number of components and also called a DI can from the drawing and ironing process. Since it is possible to iron the body wall thin and make the container lightweight, the DI can can economize on consumption of the material. The DI can is simple in its manufacturing process and has a good productivity so that it can be mass-produced to meet a great demand. Further, the DI can causes little leakage and has a good appearance. Consequently, the DI can has rapidly come into wide use as a container for carbonated drink and beverage having a high internal pressure, such as beer and soda, or as an aerosol container for cosmetics.

In contrast to the three-piece can which has its seam exposed on the cylindrical body made of a flat sheet bent and joined together, the two-piece can is advantageous in that it is seamless and has a good display effect, thus being particularly suitable for a container of cosmetics required to have a beautiful appearance.

Since the conventional DI can is of a construction where the body is integral with the bottom and the cover is curled tight to fasten it to the body, the tight curl of the cover is exposed at the shoulder of the container, worsening the appearance. Accordingly, there was proposed a reversed DI can wherein the body is integral with the cover and the bottom is fitted in the body and curled tight to fasten it to the body. In such a can construction having the cover and the body integral with each other, no curl is formed at the shoulder of the container so that a metal container having a better appearance than the conventional DI can can be obtained. Even such a container, however, exposes a curl for fastening the body to the container bottom. Therefore, it still remains unpleasing to the eye.

Accordingly, an object of the present invention is to provide a method of manufacturing a metal container which appears to have a mono block construction formed of a one-piece member, without exposing outside the tight curl for fastening the bottom to the body.

Another object of the present invention is to provide the above method of manufacturing a metal container which has a good seal at the joint between the bottom plate and the body.

A further object of the present invention is to provide a method of manufacturing a metal container which heightens its pressure-resisting strength at the bottom by improving the structure of the bottom plate.

Still a further object of the present invention is to provide a method of manufacturing the above metal container which prevents the occurrence of an explosion accident when the container is heated in a sealed condition by mistake, by using a synthetic resin material for the bottom plate.

Still a further object of the present invention is to provide a method of manufacturing the above metal container which can exert a self-sealing performance in case the bottom plate is made of a synthetic resin.

Still a further object of the present invention is to provide a method of manufacturing the above metal container which has an easily openable cover.

Still a further object of the present invention is to provide a method of manufacturing the metal container which permits application of a spray valve of a small diameter less than one inch, so as to reduce cost and make it pleasing to the eye.

Other objects and advantages of the present invention will be apparent from the following description.

SUMMARY OF THE INVENTION

The present invention relates to a method of manufacturing a metal container comprising a drawn and ironed body means made of metal having an integral top cover, and a bottom plate means having a curved surface projecting toward the interior of the container and a cylindrical portion extending parallel to the body means. The container includes an adhesive means for attaching the cylindrical portion of the bottom plate means to the body means, and a tight curl means formed by curling the lower portion of the body means inwardly and fasten the lower part of the cylindrical portion of the body means. The bottom plate means is fitted to the lower part of the body means and attached thereto by the adhesive means so as to fasten them by the tight curl means, without exposing the tight curl means outside of the container.

In particular, the present invention relates to a method of manufacturing a metal container comprising the steps of blanking and drawing a metal sheet material into a cup, drawing and ironing the cup into a can having a body and a top cover integral therewith, fitting a bottom plate in the can, the bottom plate having a curved surface projecting toward the interior of the container and a cylindrical portion extending parallel to the body. The method further comprises the steps of applying an adhesive means on the body and/or the cylindrical portion, attaching the bottom plate to the body by curling the lower part of the body inwardly to fasten it to the lower part of the cylindrical portion, and forming a closable opening on the top cover.

DETAILED DESCRIPTION OF PREFERRED EMBODIMENTS

Figure 1:
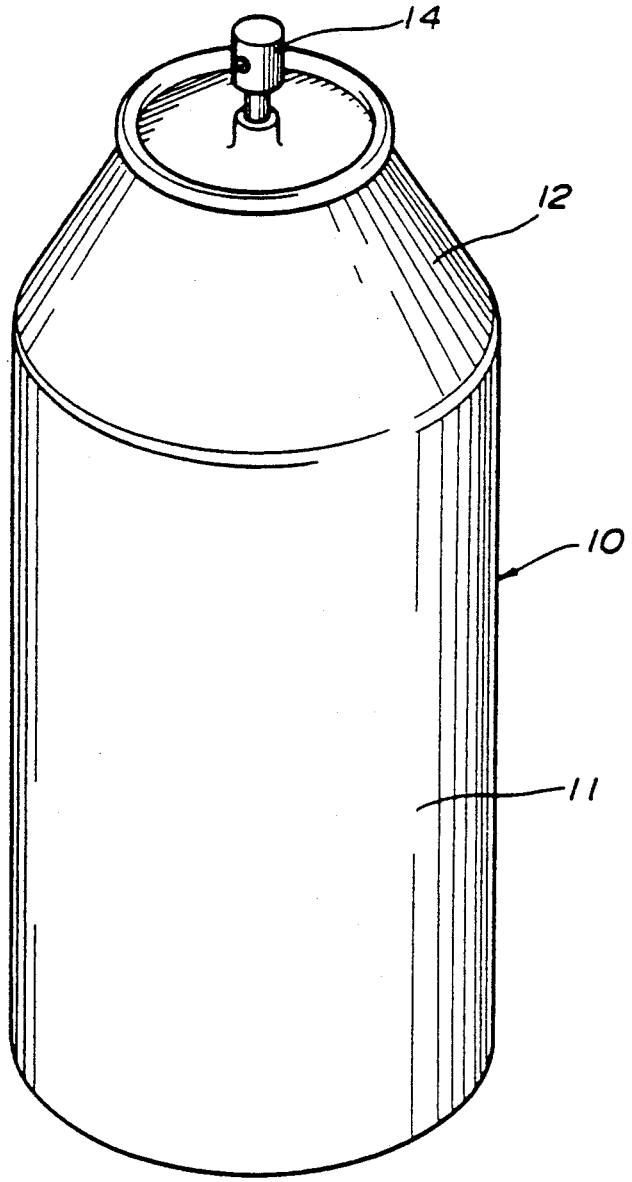
FIG. 1 is a perspective view of a metal container according to the present invention.

Referring to FIGS. 1 to 4, there is shown a metal container 10 according to the present invention. The metal container 10 comprises a body 11 integral with a top cover 12, and a bottom plate 13 fitted in and fastened to the bottom of the body 11 by curling them tight inwardly. The metal container 10 shown is an aerosol container containing, for example, liquid or powdered cosmetics together with pressurized gas, and a spray nozzle 14 is mounted in the center of the top cover 12 for ejecting the content when pressed down by the operator's finger.

Figure 2:
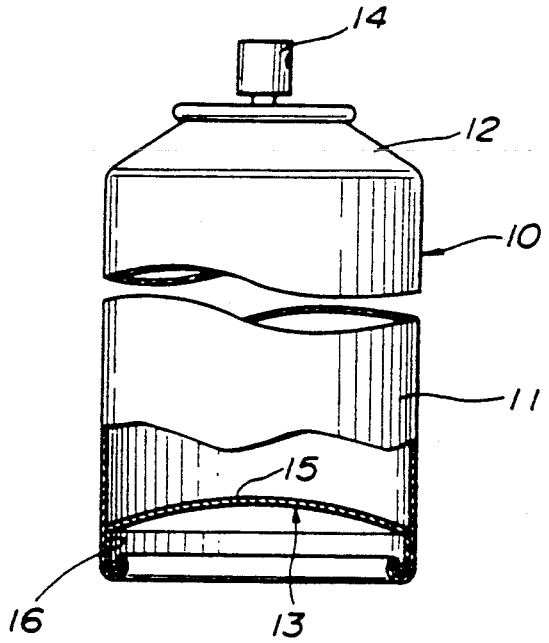
FIG. 2 is a partial, vertical sectional elevational view of the container shown in FIG. 1.
Figure 3:
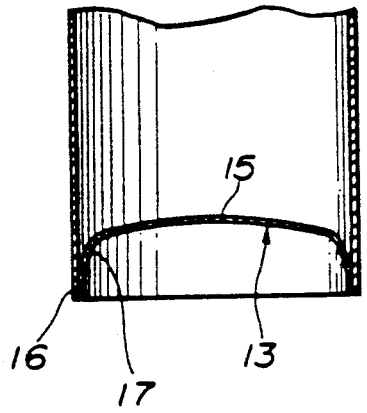
FIG. 3 is a partial, vertical sectional view of a container bottom where a bottom plate is fitted in a body.
Figure 4:
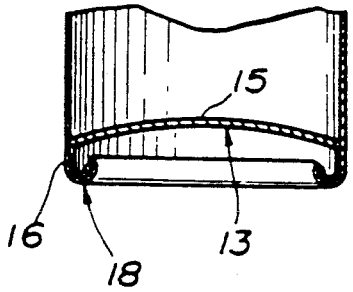
FIG. 4 is a partial, vertical sectional view of the container bottom with the body and the bottom plate being curled tight together.

The bottom plate 13, as shown in FIG. 3, has an arcuate curved portion 15 projecting inwardly, a cylindrical portion 16 extending parallel to the body 11, and an inclined portion 17 extending straight in section and provided between the curved portion 15 and the cylindrical portion 16. The inclined portion 17 serves to keep contraction of the cylindrical portion 16 and the body 11 at an appropriate ratio when the bottom plate 13 is fitted in the body and curled tight together, preventing a tight curl 18 from wrinkling. The cylindrical portion 16 of the bottom plate 13 is attached to the body 11 with an adhesive to improve sealing performance and strengthen the joint. The tight curl 18 for fastening the body 11 to the bottom 13 is arranged to be directed inwardly, as shown in FIGS. 2 and 4, so that no tight curl 18 is exposed at the bottom of the container 10 as shown in FIG. 1. Therefore, the container assumes an appearance of a mono block structure made of a one-piece member. Thus this container 10 is most suitable for a container of cosmetics required to have a beautiful appearance.

Figure 5:
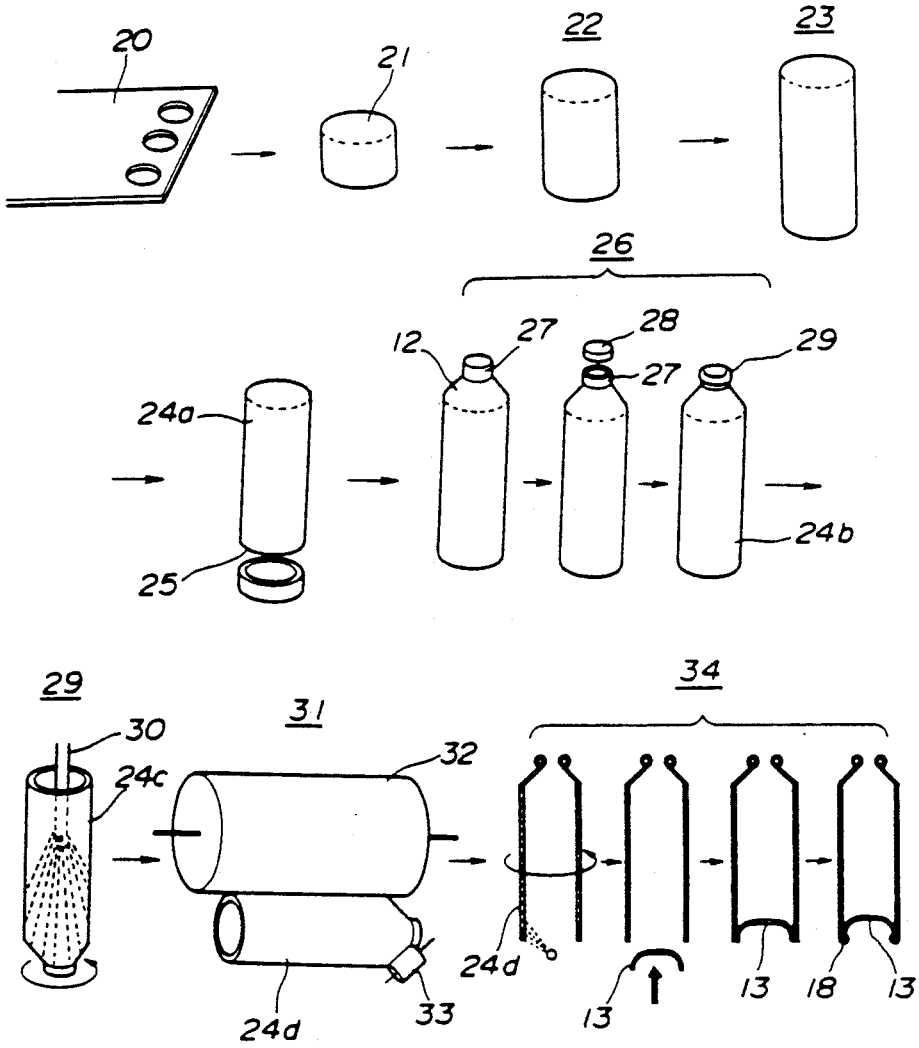
FIG. 5 shows the process steps of manufacturing the metal container of the present invention.

A method of manufacturing the metal container according to the present invention will be described with reference to FIG. 5. The numeral 20 is a metal sheet, such as aluminium, stainless steel, etc., which is blanked and drawn into a cup 21 by a cupping press. Then the cup 21 is fed to a process 22 performed by a drawing and ironing press (DI press) where it is redrawn to reduce its diameter, and thereafter undergoes an ironing process 23 with an ironing die so as to elongate the cup and obtain the body wall of a desired thickness. The DI pressed can 24*a* is fed to a trimmer belonging to the DI press where a lower end portion 25 is trimmed to a certain dimension. The trimmed can is fed to a process 26 for forming a bead at the mouth to which a spray nozzle is mounted. In the bead forming process 26, pressing is performed to form the top cover 12 into a head-cut conical shape and then to form a cylindrical opening 27 protruding upward in the center of the top cover. The cylindrical opening 27 corresponds in diameter to a spray nozzle mount. Subsequently, an upper end portion 28 of the cylindrical opening 27 is cut off, followed by a step of forming a bead 29 by curling. The bead-formed can 24*b* proceeds to a washing process, not shown, where its internal and external surfaces are defatted by alkali shower, etc., water-washed and then dried.

The washed can 24*b* is fed to an inner coating process 29 where its internal surface is coated by a spray means 30 and then dried. The inner-coated can 24*c* is transferred to an outer-coating/printing process 31, where the can is outer-coated and printed by a roller coating means, for example, a coat roller 32 and a shoulder roller 33. The inner-coating process 29 and the outer-coating/printing process 31 may be reversed in order.

Figure 6:
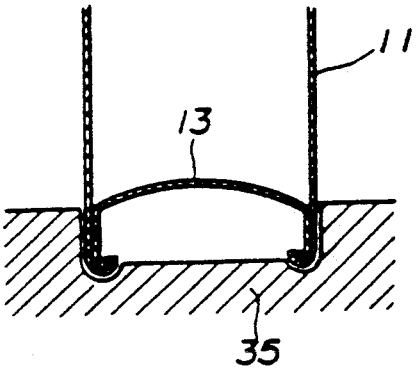
FIG. 6 is a vertical sectional view of a die for curling the body and bottom plate.
Figure 7:
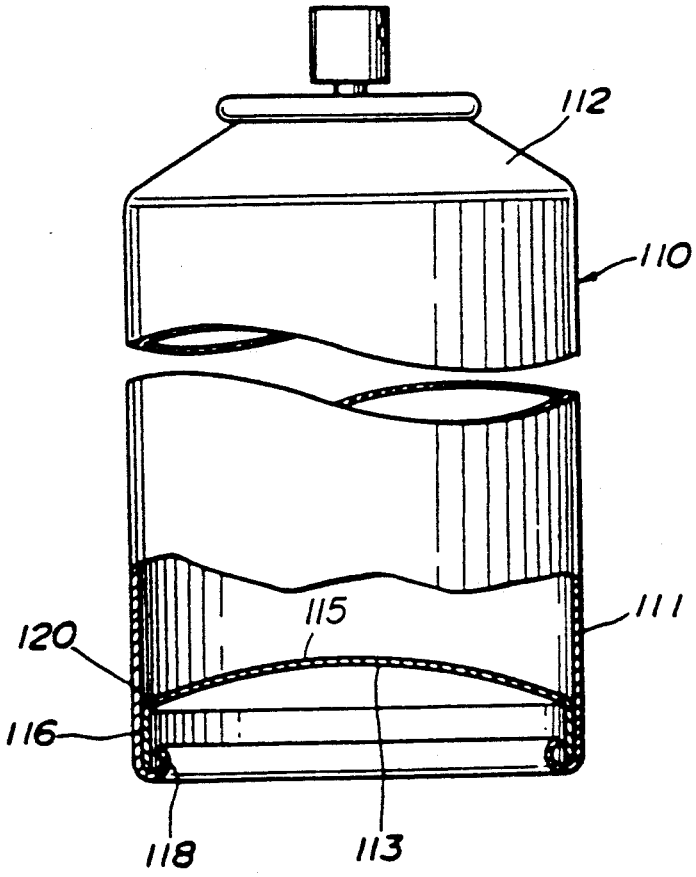
FIG. 7 is a partially vertical sectional elevational view of a metal container showing a first modification of the present invention.
Figure 8:
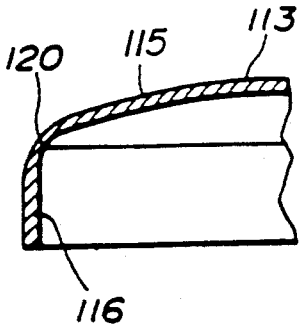
FIG. 8 is an enlarged partial vertical sectional view of a bottom plate according to the first modification.

Thus inner/outer coated and printed can 24*d* is fed to a bottom plate mounting process 34, where the bottom plate 13 is put in place. In the bottom plate mounting process 34, an adhesive is sprayed on the inner circumferential surface of the lower portion of the can 24*d*, whereafter the bottom plate 13 is fitted to the can. After the cylindrical portion 16 of the bottom plate 13 and the lower end of the body 11 are sufficiently attached together, the can is inserted in a forming die 35 as shown in FIG. 6 and pressed in the longitudinal direction to curl tight the cylindrical portion 16 and the body 11 toward the interior of the container and fasten them together. After the tight curling process is finished, the spray nozzle 14 is mounted to the bead 29, whereupon the manufacture of the metal container of the present invention is completed. The tight curl is not limited to the illustrated type having a circular curl in section. Any sort of inward fold which grips the bottom plate sufficiently firmly to fix it to the body and seal it thereto will suffice.

Attachment of the body 11 and the bottom plate 13 is not limited to that by the adhesive sprayed in the body lower portion. The can 24c may be inner-coated with thermoplastic synthetic resin and after the bottom plate 13 is fitted in this can, the inner-coating layer may be melted by electromagnetic induction heating or laser beam so as to put them together. Melted thermoplastic synthetic resin serves to preliminary seal the metal sheets of the fitted parts, and the subsequent tight curling process promotes and ensures airtightness at the joint between the body 11 and the bottom plate 13, thereby preventing leakage from the joint even if the container is stocked for a long time.

The body 11 and the bottom plate 13 are preferably made of the same material. This causes no difference of thermal expansion therebetween so that no relative slippage occurs at the joint and a reliable sealing structure is attainable.

FIGS. 7 to 10 show a metal container 110 according to a first modification of the invention, comprising a body 111 including a top cover 112, and a bottom plate 113, both made of aluminium. The bottom plate 113 has an upward curved portion 115 in the upper center and a cylindrical portion 116, as previously mentioned, of which the periphery, namely the boundary between portions 115 and 116, is formed as a partially thin bending portion 120.

The cylindrical portion 116 has a predetermined external diameter in accordance with the body 111 so that it is pressed therein with so-called interference fit. Between the cylinderical portion 116 and the body 111, an adhesive is applied. The grade of fit between the body 111 and the bottom plate 113 is determined in accordance with the subsequent tight curling process. The lower end of the body 111 protrudes downward from the end of the cylindrical portion 116 by the length corresponding to the cross-sectional length of a tight curl 118.

The radius of curvature at the inner circumference of the bending portion 120 is preferably one to three times as thick as the bottom plate 113. By drawing the bottom plate into such a configuration, the bending portion 120 has approximately 80% thickness of the bottom plate. In the embodiment as shown, the body 111 has an internal diameter of 50 mm and the bottom plate 113 is 3.8 mm thick with the bending portion 120 of about 3.0 mm thickness. Further, the radius curvature at the curved portion 115 of the bottom plate 113 is 50 mm which is the same as the internal diameter of the body.

Subsequently, the tight curling process is performed with use of the curling die 35 as shown in FIG. 6, whereupon the lower end of the cylindrical portion 116 comes into contact with the inner circumferential lower end of the tight curl 118.

Figure 10:
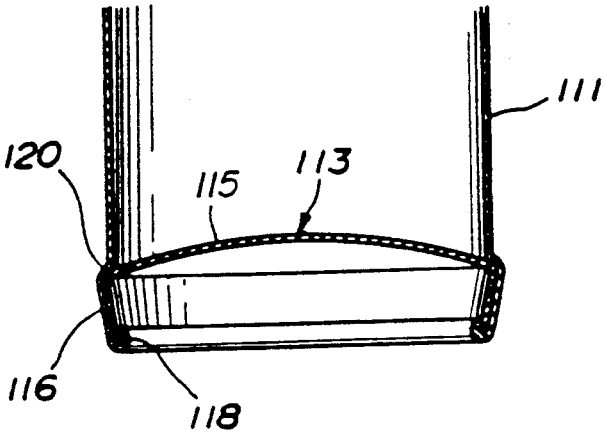
FIG. 10 is a partial sectional view of the first modification showing in emphasis the body deformation under the internal pressure applied on the bottom plate.

When a pressure container of the above construction increases in its internal pressure and the curvature of the bottom plate 113 becomes larger than its initial value, the bending portion 120 thrusts into the body 111 as shown in FIG. 10 and the adhesive seal is promoted by the following action.

Namely, when the pressure container with its bottom closed by the bottom plate 113 increases in the internal pressure, the container is under the same condition as a load concentrates on the center portion of the bottom plate 113, and the center portion tries to deform in reverse and protrude downward. At this time, the bottom plate 113 having the partially thin bending portion 120 at the periphery has a weak rigidity in the direction of preventing the reverse deformation so that the peripheral diameter of the bottom plate 113 tries to expand with the increase in the container internal pressure at the stage prior to the reverse deformation. This diameter expansion, however, is prevented by the body 111. Further, since the cylindrical portion 116 of the bottom plate 113 is in contact with the tight curl 118 and prevented from its axial movement, the cylindrical portion 116 generates a force pressing toward the body 111, thereby increasing contact pressure where the cylindrical portion 116 is attached to the body 111. The increasing tendency of the contact pressure is most remarkable at the upper end of the cylindrical portion 116, i.e. in the proximity of the bending portion 120. (See FIG. 10.)

Even if the above bottom-sealed pressure container comprises the body 111 and the bottom plate 113 both made of less rigid aluminium, it will exert a sufficient strength against pressure by the above-described action. Further, since the tight curl 118 is formed toward the interior of the container 110, the container has a better appearance than the conventional one with the tight curl 118 exposed outside.

Figure 9:
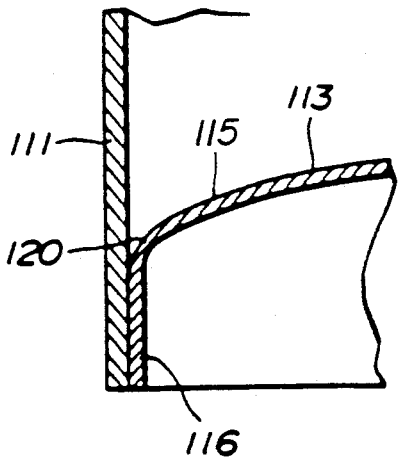
FIG. 9 is an enlarged partial vertical sectional view showing the fitting condition of the body and bottom plate according to the first modification.

If the adhesive requires a relatively long time (approximately several minutes) for curing, the bottom plate 113 may be pressed in so that the lower end of the cylindrical portion 116 is aligned with that of the body 111, as shown in FIG. 9. The subsequent tight curling process advances, pushing the bottom plate 113 inwardly, and at the completion of this process, the bottom plate 113 is held at a predetermined position and the lower end of the cylindrical portion 116 comes into contact with the inner circumference of the tight curl 118.

Further, the body 111, including the top cover 112, and the bottom plate 113 may be made of a tin plate or surface treated steel sheet.

Figure 11:
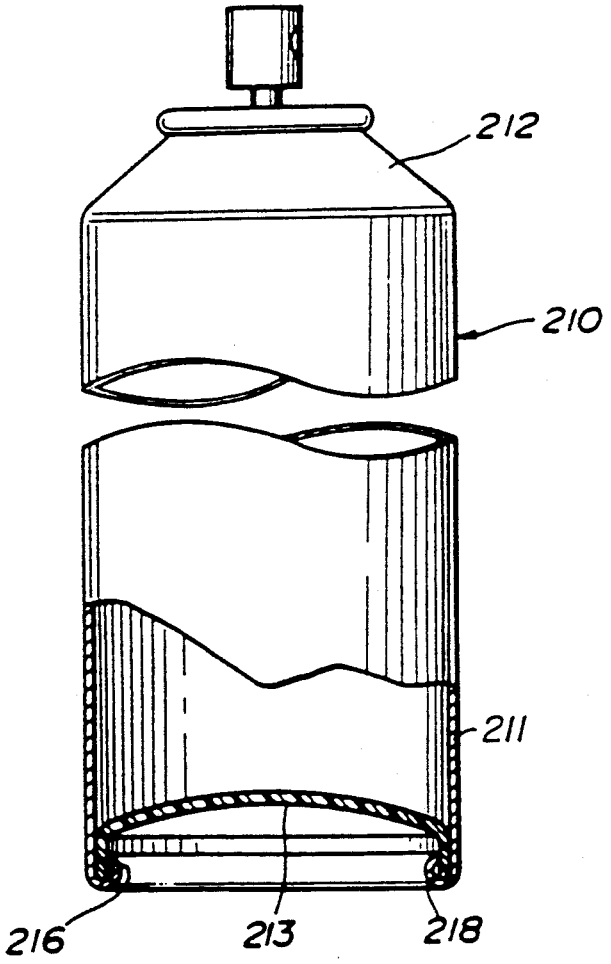
FIG. 11 is a partially vertical sectional elevational view of a metal container showing a second modification of the present invention.
Figure 12:
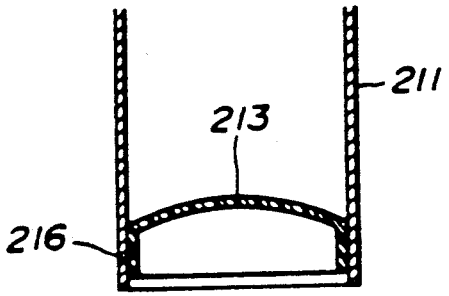
FIG. 12 is a partial vertical sectional view showing the fitting condition of the body and bottom plate according to the second modification.
Figure 13:
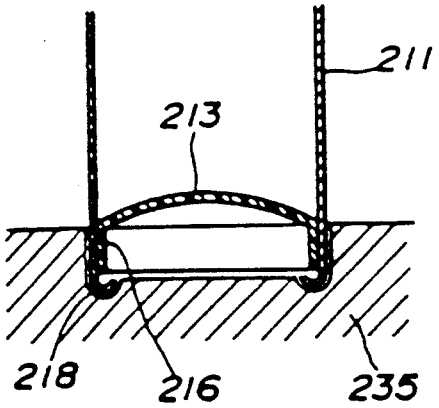
FIG. 13 is a partial vertical sectional view showing the condition that the body is curled to fasten it to the bottom plate, according to the second modification.

FIGS. 11 to 13 show a metal container 210 according to the second modification of the invention. As embodied herein as an aerosol pressure container, the container comprises an aluminium body 211 including a top cover 212 and a synthetic resin bottom plate 213 having a melting point at about 80° C. The bottom plate 213 is pressed in the bottom of the body 211 at a predetermined grade of fit and the lower end of the body 211 is curled at a temperature near the melting point of plate 213, whereupon a tight curl 218 is formed and its inner circumferential edge thrusts, to a certain extent, into the inner circumferential surface of a cylindrical portion 216 hanging down at the periphery of the bottom plate 213.

Manufacture of the respective parts will be described in detail hereinbelow. The body 211 including the top cover 212 is shaped by the process as shown in FIG. 5. The bottom plate 213 is formed into a pan-like shape by extrusion molding using, for example, polyethylene terephtalate (PET), acrylonitrile thermoplastic synthetic resin, polypropylene resin (PP), etc. The bottom plate 213 has its top center formed as an upward curved portion and is provided with the cylindrical portion 216 at the entire periphery thereof. The cylindrical portion 216 has a predetermined external diameter in accordance with the body 211, and is pressed therein with so-called interference fit. The adhesive is applied between the cylindrical portion 216 and the body 211. The bottom plate 213 is fitted in the body 211 at a predetermined degree in accordance with the tight curling process, and as shown in FIG. 12, the lower end of the body 211 protrudes downward from the lower end of the cylindrical portion 216 by the length corresponding to the cross-sectional length of the tight curl 218.

Subsequently, the combined body 211 and bottom plate 213 is curled with use of a curling die 235 as shown in FIG. 13 at a temperature near the melting point of the synthetic resin forming the bottom plate 213. Then the lower end of the cylindrical portion 216, as shown in FIG. 11, is fastened by a tight curl 218 with the inner circumferential lower edge being in contact with the tight curl 218, while the inner circumferential edge of the tight curl 218 thrusts into the inner circumference of the cylindrical portion 216.

If the metal container can be less pressure-resisting, the bottom plate may be formed of less rigid material, in which case it is unnecessary to heat the material at the melting temperature during the curling process.

In this modification, the body 211 including the top cover is made of aluminium and it may be replaced by a tin plate or surface treated steel sheet.

According to the metal container 210 of this embodiment, the cylindrical portion 216 of the bottom plate 213 and the body 211 are fastened together by the tight curl 218. This fastening structure ensures airtightness at the joint between the body 211 and the bottom plate 213, thereby sealing the container. If this sealed container is burned up by mistake, the overall container will be subject to a high temperature condition. In such an event the bottom plate 213 made of synthetic resin melts or highly softens so that the bottom plate 213 thermally damages or ruptures, thereby letting off the pressure before the pressure inside the container becomes very high.

Thus, this container is safe in that it does not explode if burned up by mistake in a sealed condition, unlike the conventional metal container.

Figure 14:
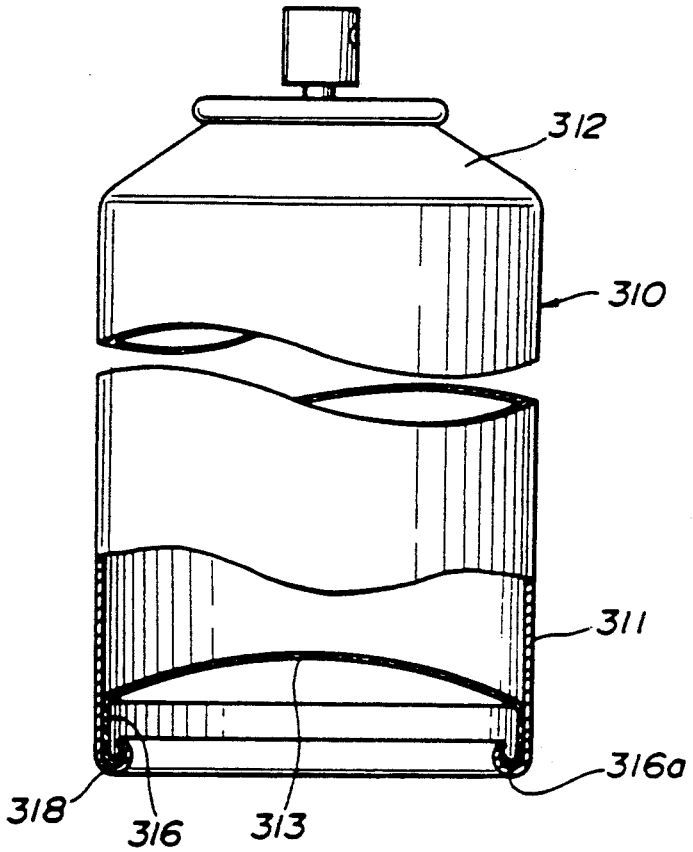
FIG. 14 is a partially vertical sectional elevational view of a metal container showing a third modification of the present invention.
Figure 15:
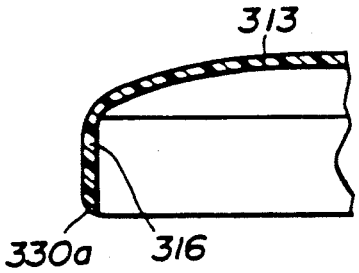
FIG. 15 is an enlarged partial vertical sectional view of a bottom plate according to the third modification.
Figure 16:
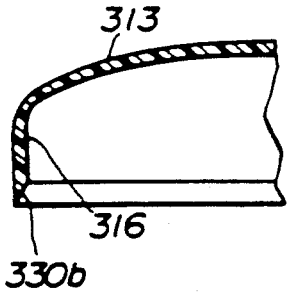
FIG. 16 is an enlarged partial vertical sectional view showing another bottom plate according to the third modification.
Figure 17:
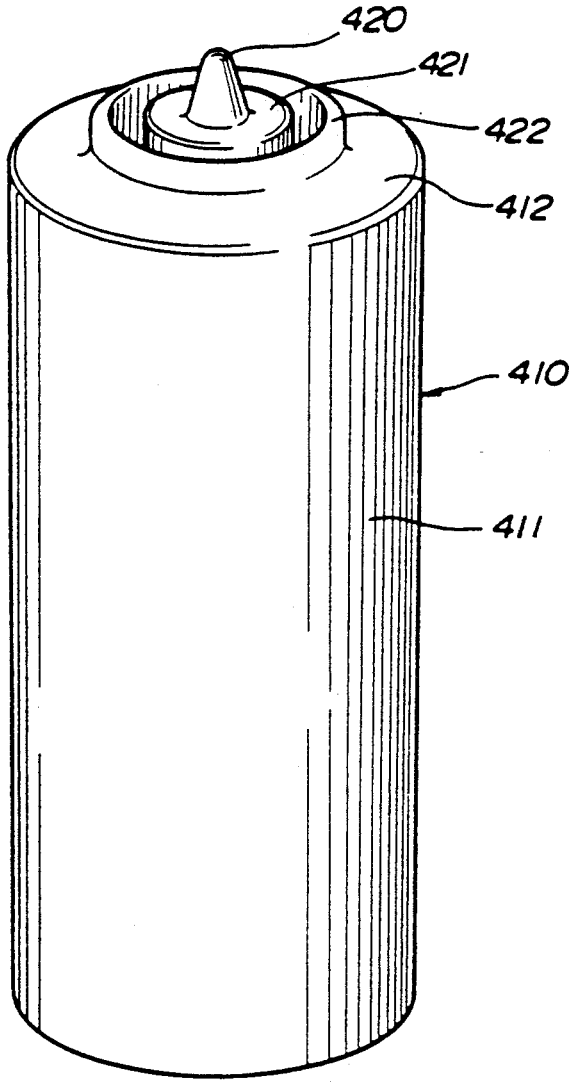
FIG. 17 is a perspective view of a metal container showing a fourth modification of the present invention.

FIGS. 14 to 16 show a metal container 310 according to a third modification of the invention. A body 311 including a top cover 312 is made of aluminium, and a bottom plate 313 is made of elastic synthetic resin. The bottom plate 313 is pressed in the lower end of the body 311 at a predetermined grade of fit, with the lower end of the body 311 slightly protruding downward from the lower end of a cylindrical portion 316 of the bottom plate 313. In this fitting condition, the lower end of the body 311 is curled tight so that both body 311 and cylindrical portion 316 have their lower ends bend inwardly and the bend in the lower part of the cylindrical portion 316 comes into contact with the inner circumference of a tight curl 318.

Manufacture of the respective parts will be described in detail hereinbelow. The body 311 including the top cover 312 is shaped by the process as shown in FIG. 5, and the bottom plate 313 is formed into a pan-like shape as shown in FIG. 15 by extrusion molding using a synthetic resin material. The upper center of the bottom plate 313 is formed as an upward curved portion, and at the periphery thereof there is provided the cylindrical portion 316 of which the outer circumferential surface is arcuate, directing inwardly. The cylindrical portion 316 has an external diameter of such a dimension that it is pressed in the body 311 with so-called interference fit. Adhesive is applied between the cylindrical portion 316 and the body 311. The grade of fit between the body 311 and the bottom plate 313 is determined in accordance with the subsequent tight curling process, in the same manner with the modification of FIG. 13, and the lower end of the body 311 protrudes downward from the lower end of the cylindrical portion 316 by the length corresponding to the arcuate length of the tight curl 318.

Subsequently when the adhesive cures, the combined body 311 and bottom plate 313 is curled tight together using the curling die 235 shown in FIG. 13, whereupon a small area in the lower end of the cylindrical portion 316 is caulked in a rolled-up condition as shown in FIG. 14. In this condition, a bend **316*a* formed in the lower end of the cylindrical portion 316 is close to the inner circumference of the tight curl 318** for a certain area.

Particularly, in the embodiment as shown, the outer circumferential surface of the lower end of the cylindrical portion 316 is formed as an inward arcuate surface **330*a* as shown in FIG. 15. The lower end of the cylindrical portion 316 is bent inwardly in contact with the inner circumferential surface of the tight curl 318, and moreover the bend 316*a* in the lower end of the cylindrical portion 316** is provided with elastic returnability.

Consequently, the bend **316*a* is pressed against the inner circumferential surface of the tight curl 318 with a certain pressure, and this condition is maintained at the entire periphery of the lower end of the cylindrical portion 316. The joint between the bottom plate 313 and the inner circumference of the body 311 is kept airtight by the pressure contact between the outer circumference of the cylindrical portion 316 and the inner circumference of the body 311, and also by the pressure contact between the bend 316*a* of the cylindrical portion 316 and the tight curl 318. Particularly, the latter pressure contact always permits the bend 316*a* of the cylindrical portion 316 to elastically return in the direction of maintaining airtightness. As a result, even if the bottom plate 313 is made of synthetic resin, the bend 316*a* exerts self-sealing performance, thereby improving the airtightness at the joint between the bottom plate 313 and the body 311**.

Further, the self-sealing performance of the elastically returnable bend **316*a* is also attainable even if the cylindrical portion 316 is cut to form a tapering inclined surface 330*b* as shown in FIG. 16**.

If the metal container is required to be pressure-resisting, the bottom plate 313 is made of highly rigid material. In this case, the material of the bottom plate 313 has a poor workability at the normal temperature and therefore is heated at the melting temperature of the material during the curling process. The material is synthetic resin, such as polythylene terephthalate (PET), acrylonitrile thermoplastaic synthetic resin, or polypropylene (PP) resin. When using such a material, the tight curling process is done at the temperature near the melting point. This facilitates bending of the lower end of the cylindrical portion 316 during the tight curling process and causes no crack or damage in said lower end during the formation of the bend **316*a*. Furthermore, this bend 316*a* is pressed into contact with the inner circumference of the tight curl 318** and remains to be elastically returnable at room temperature.

In the process related to the above embodiment, curling is performed after the adhesive cures. However, it is also possible to insert a fixing rod through the upper opening of the body 311 to fix the position of the bottom plate 313, so as to put the bottom plate 313 in a proper position where the bend **316*a*** of the cylindrical portion 316 is in contact with the inner surface of the tight curl 318.

FIGS. 17 to 20 show a metal container according to a fourth modification of the invention, which is adapted for use as a container for drinks and beverages, such as beer and soda, having a top cover 412 with a tear-open portion easily openable by finger.

Similiarly with the above embodiments, a body 411 is integral with the top cover 412, and a bottom plate 413 is fitted in the bottom of the body 411 and curled tight to form a tight joint.

Figure 18:
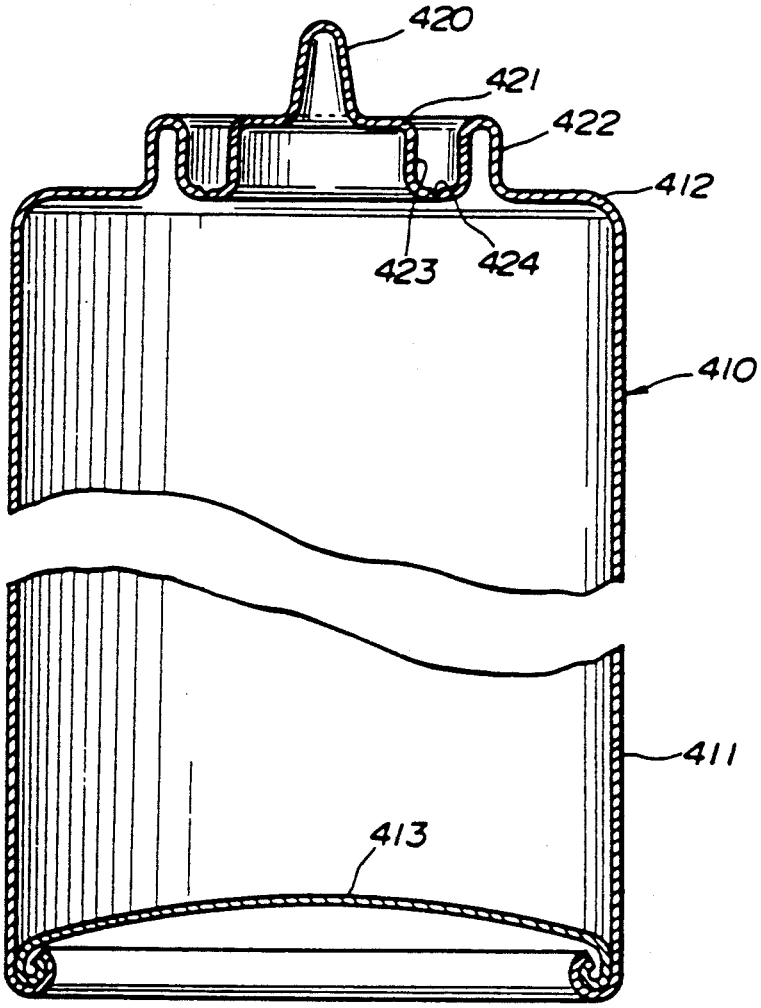
FIG. 18 is a vertical sectional view of the fourth modification.
Figure 19:
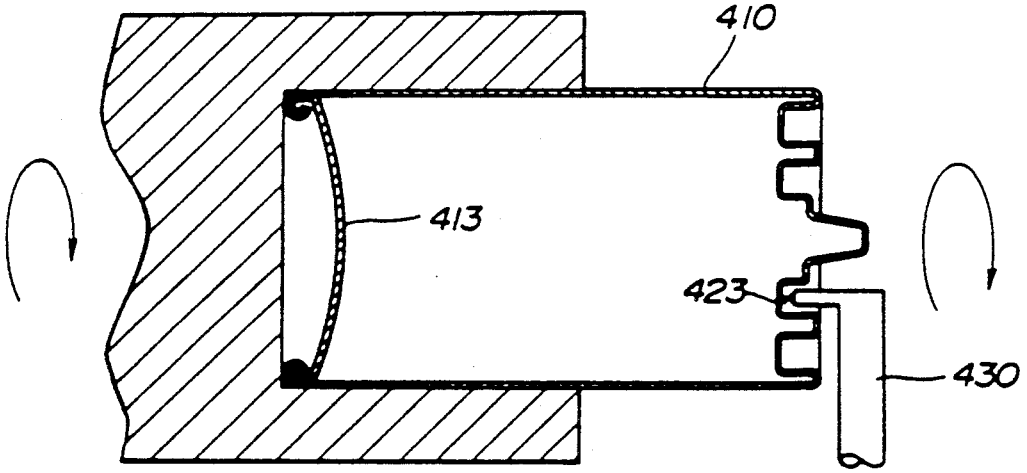
FIG. 19 is a vertical sectional view showing a process of forming a tear-open portion in the fourth modification.

As shown in FIG. 18, the top cover 412 comprises a central projection 421 having a tab 420 openable by finger, and an annular projection 422 being concentric with the central projection 421. Between the central and annular projections 421 and 423, there is provided an annular bottom 423 of a certain width. As shown in FIG. 19, the container 410 is adapted to rotate with a cutting tool 430 being provided in the center of the annular bottom 423 in order to form an annular thin portion 424 as shown in FIG. 18.

If the top cover 412 is made of aluminium having a thickness of about 0.5 mm, the thin portion 424 may be about 0.1 mm thick (20% thickness of the top cover). By pushing down the tab from one side by finger, the area enclosed by the thin portion 424 is cut off from its periphery, thereby making the container 410 easily openable. After the container 410 is opened, the annular projection 422 protrudes around the opening and protects a drinker from cutting his lip by the cut end.

Figure 20:
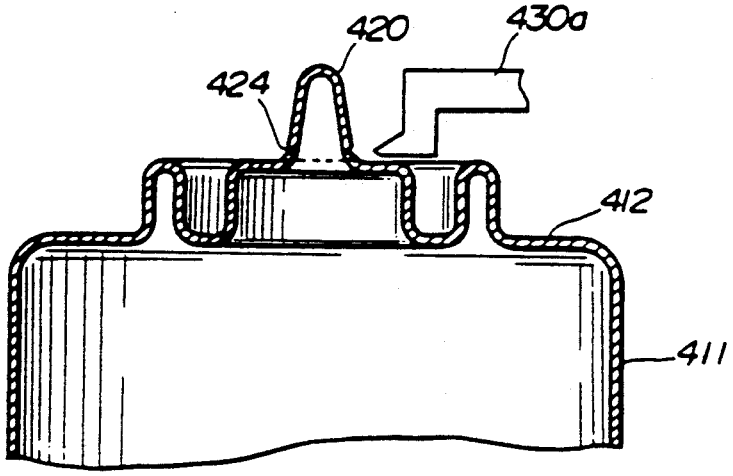
FIG. 20 is a partial vertical sectional view showing another process of forming the tear-open portion in the fourth modification.

The thin portion 424 may be formed at the lower part of the tab 420 as shown in FIG. 20. In this case, a cutting tool 430*a* is applied at a right angle to the rotating curved surface.

Thus constructed, this container is easily opened only by pushing down the tab 420 from one side by finger, whereby only the tab 420 is cut off from the top cover 412.

In the above embodiments, the tab 420 is formed integral with the top cover 412, but it may be separate from the top cover 412 and attached thereto by caulking or with an adhesive.

Figure 21:
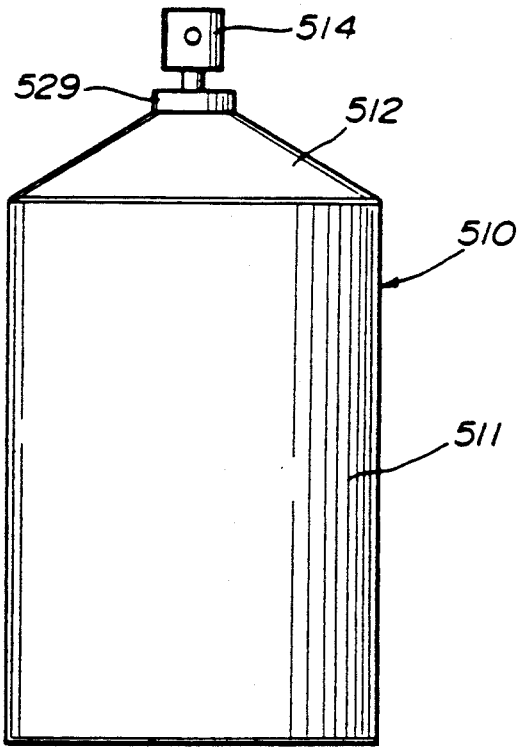
FIG. 21 is a perspective view of a metal container showing a fifth modification of the present invention.
Figure 22:
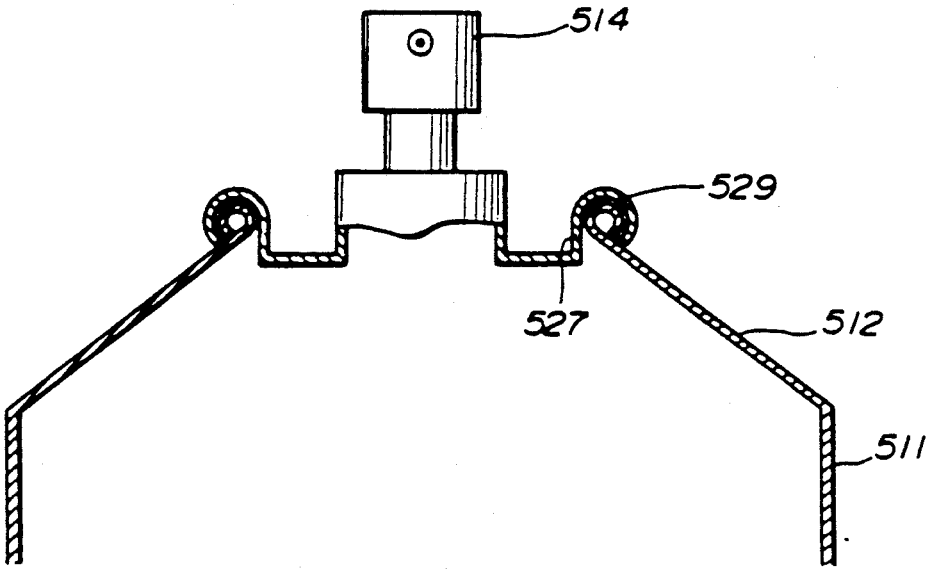
FIG. 22 is an enlarged partially vertical sectional view of the fifth modification.

FIGS. 21 and 22 show a metal container 510 according to a fifth modification of the invention, which has a top cover 512 attached with a spray nozzle 514 having a valve of a smaller diameter than the widely used one inch valve.

In this metal container, as described with reference to the process of FIG. 5, the center of the top cover 512 is processed to thrust upward to form a cylindrical opening 527, which is then curled to form a bead 529. Accordingly, the cylindrical opening 527 can be of any diameter corresponding to the diameter where the spray nozzle 514 is to be mounted, thereby permitting application of the spray nozzle of any diameter almost without restriction.

Because the diameter of the cylindrical opening 527 corresponds to the diameter where the spray nozzle is to be mounted, there is little draw-in of the diameter when curling the cylindrical opening 527 to form the bead 529, thereby causing no creases or wrinkles due to working distortion and providing the bead 529 with a smooth, beautiful inner circumferential surface. Consequently, it is possible to use a liquid rubber coated layer as a sealer interposed between the bead 529 and the spray nozzle mount, for cost reduction. Further, the use of the spray nozzle 514 having a small diameter makes the container to have a fine appearance and a good design, allowing it to be suitable for use as a container of cosmetics.

Figure 23:
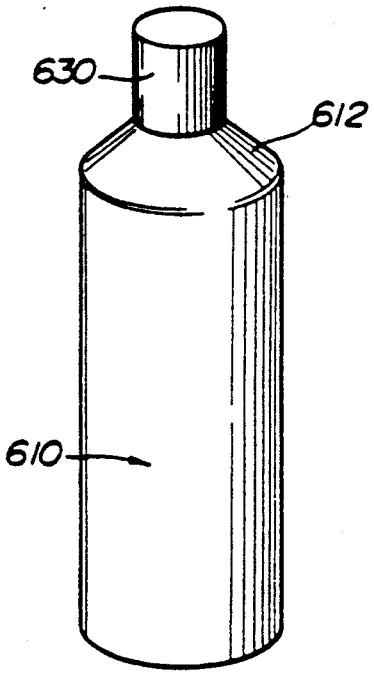
FIG. 23 is a perspective view of a metal container showing a sixth modification of the present invention.
Figure 24:
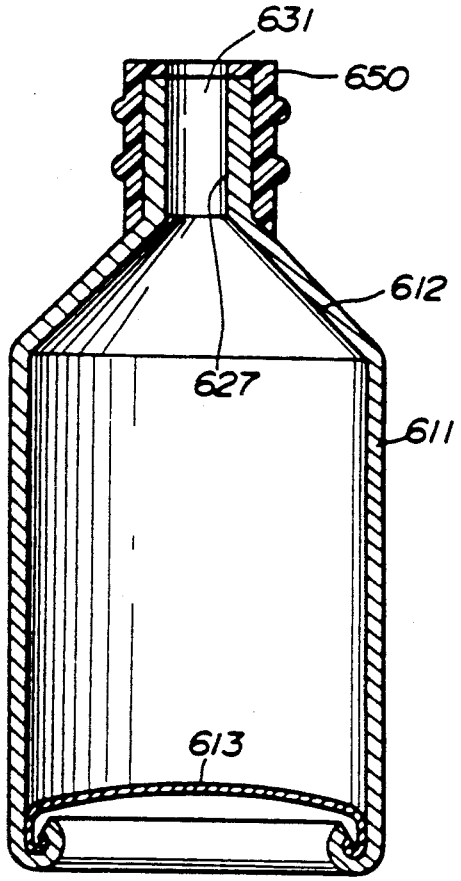
FIG. 24 is an enlarged vertical sectional view of the sixth modification.

FIGS. 23 and 24 show a metal container 610 according to a sixth modification of the invention, which has a cap 630 detachable by threaded means.

In the same manner with the above embodiments, a body 611 is provided integral with a top cover 612 and a bottom plate 613 is fitted in the bottom of the body 611 to be curled and fastened thereat.

As described with reference to FIG. 5, a cylindrical opening 627 is formed in the center of the top cover 612, without forming a bead, and the cylindrical opening is provided with a mouth 631 in the upper end thereof. A threaded tube member 650 made of synthetic resin is fitted on the outer circumference of the cylindrical portion 627 and fixed thereto. A cap 630 is detachably screwed on the threaded tube member 650. If the cylindrical portion 627 is of a sufficient thickness, threading may be formed directly on the outer circumferential surface thereof.

While the invention has been described in its preferred embodiments, it is to be understood that changes and variations may be made within departing from the spirit and scope of the invention.

What is claimed is:

1. A method of manufacturing a metal container comprising the steps of:

(a) blanking and drawing a metal sheet material into a cup;

(b) drawing and ironing said cup into a can having a body integral with a top cover, wherein the drawing reduces the diameter of the cup and the ironing elongates the cup and forms a predetermined wall thickness of the body;

(c) forming a bottom plate having a central curved surface portion for projecting toward the interior of the container, a peripheral cylindrical portion for extending parallel to said body, and a bending portion formed at the boundary between the curved surface portion and the cylindrical portion and having a reduced thickness to that of the curved surface portion and cylindrical portion;

(d) applying an adhesive means on said body and/or said cylindrical portion;

(e) fitting said bottom plate in the bottom of said body;

(f) curling tight the lower part of said body inwardly so as to fasten and attach said bottom plate to said body; and (g) forming a closable opening on the top cover.

2. A method of manufacturing a metal container as claimed in claim 1, wherein step (g) includes the step forming an upward cylindrical opening in the center of the top cover, following step (b) of drawing and ironing the cup into the can.

3. A method of manufacturing a metal container as claimed in claim 2, wherein step (g) includes the step of forming a bead for mounting a spray nozzle thereto by curling the cylindrical portion.

4. A method of manufacturing a metal container as claimed in claim 2, wherein step (g) includes the step of forming a mouth by cutting the upper end of the cylindrical opening and forming a threaded means for screwing a cap means onto the outer circumference of the cylindrical portion.

5. A method of manufacturing a metal container as claimed in claim 1, wherein step (g) includes the step of forming an upward tab in the center of the top cover and forming a thin tear-open portion around said tab.

6. A method of manufacturing a metal container as claimed in claim 1, further comprising the step of applying an inner coating on the inner surface of the drawn and ironed can.

7. A method of manufacturing a metal container as claimed in claim 1, further comprising the step of coating and printing the outer surface of the drawn and ironed can.

8. A method of manufacturing a metal container as claimed in claim 1, wherein step (c) comprises forming the bottom plate of a metal sheet material similar to the metal sheet material of the cup.

9. A method of manufacturing a metal container as claimed in claim 1, wherein step (c) comprises forming the bottom plate of a synthetic resin material.

10. A method of manufacturing a metal container as claimed in claim 9, wherein step (f) comprises curling at a temperature near the melting point of the synthetic resin forming the bottom plate.

11. A method of manufacturing a metal container as claimed in claim 9, wherein step (c) comprises forming the bottom plate by extrusion molding.

* * * * *